US009027554B2

(12) United States Patent
Lee et al.

(10) Patent No.: US 9,027,554 B2
(45) Date of Patent: May 12, 2015

(54) RESPIRATOR HAVING FOAM SHAPING LAYER WITH RECESSED REGIONS SURROUNDING AIR PASSAGEWAYS

(75) Inventors: Jin-Ho Lee, Seoul (KR); Jungchul Moon, Seoul (KR); Kangsoo Park, Osan-Si (KR); Dong-Sun Noh, Bucheon-Si (KR)

(73) Assignee: 3M Innovative Properties Company, St. Paul, MN (US)

( * ) Notice: Subject to any disclaimer, the term of this patent is extended or adjusted under 35 U.S.C. 154(b) by 211 days.

(21) Appl. No.: 13/311,603

(22) Filed: Dec. 6, 2011

(65) Prior Publication Data

US 2013/0139823 A1 Jun. 6, 2013

(51) Int. Cl.
*A62B 23/02* (2006.01)
*A62B 18/02* (2006.01)

(52) U.S. Cl.
CPC ..... *A62B 23/025* (2013.01); *A62B 18/02* (2013.01)

(58) Field of Classification Search
CPC ..... A61M 16/06; A62B 18/02; A62B 18/025; A62B 18/06; A62B 18/08; A62B 23/025; A62B 23/02
USPC ..... 128/206.12–206.19, 206.21–207.13
See application file for complete search history.

(56) References Cited

U.S. PATENT DOCUMENTS 3,276,445 A * 10/1966 Langdon ..... 128/206.15
4,454,881 A 6/1984 Huber et al.
4,536,440 A 8/1985 Berg
4,600,002 A 7/1986 Maryyanek et al.
4,723,542 A * 2/1988 Giffard ..... 128/859
4,790,306 A 12/1988 Braun
4,807,619 A * 2/1989 Dyrud et al. ..... 128/206.16
4,827,924 A 5/1989 Japuntich
4,850,347 A 7/1989 Skov
4,873,972 A 10/1989 Magidson et al.
5,094,236 A * 3/1992 Tayebi ..... 128/206.12
5,307,796 A 5/1994 Kronzer et al.

(Continued)

FOREIGN PATENT DOCUMENTS

CA 1296487 3/1992
JP 11-104253 4/1999

(Continued)

OTHER PUBLICATIONS

International Application No. PCT/US2012/067753 Search Report dated Mar. 22, 2013.

*Primary Examiner* — Valerie L Skorupa
(74) *Attorney, Agent, or Firm* — Karl G. Hanson

(57) ABSTRACT

A filtering face mask 10 that has a harness 14 and a mask body 12. The mask body 12 includes a filtering structure 18 and a cup-shaped shaping layer 20 where the latter comprises a closed cell foam layer that has a plurality of fluid permeable openings 22 located in it. The openings 22 are surrounded by recessed regions 31. The filtering structure 18 does not make substantial contact with the shaping layer 20 at the recessed regions. The shaping layer 20 makes contact with the wearer's face at the mask body perimeter 19 when the respirator is being worn. The use of a foam shaping layer that has openings surrounded by recessed regions provides sufficient structural integrity or stiffness to prevent mask body collapse during respirator use while also exhibiting a low pressure drop and rapid fluid distribution of air within the mask to allow for low breathing resistance and extended wearer comfort.

20 Claims, 2 Drawing Sheets

(56) References Cited

U.S. PATENT DOCUMENTS

| | | | | |
|---|---|---|---|---|
| 5,558,089 | A | 9/1996 | Castiglione | |
| 5,617,849 | A | 4/1997 | Springett et al. | |
| 5,673,690 | A | 10/1997 | Tayebi et al. | |
| D412,573 | S | 8/1999 | Castiglione | |
| 6,041,782 | A | 3/2000 | Angadjivand et al. | |
| 6,568,392 | B1 | 5/2003 | Bostock et al. | |
| 6,923,182 | B2 | 8/2005 | Angadjivand et al. | |
| 7,086,400 | B2 | 8/2006 | Shigematsu et al. | |
| RE39,493 | E | 2/2007 | Yuschak | |
| 7,845,354 | B2 * | 12/2010 | Kwok et al. | 128/207.12 |
| 8,176,918 | B2 | 5/2012 | Teng | |
| 8,342,180 | B2 | 1/2013 | Martin | |
| 2003/0029454 | A1 * | 2/2003 | Gelinas et al. | 128/205.27 |
| 2006/0266364 | A1 | 11/2006 | Turdjian | |
| 2007/0068529 | A1 | 3/2007 | Kalatoor et al. | |
| 2008/0023006 | A1 | 1/2008 | Kalatoor | |
| 2008/0223370 | A1 * | 9/2008 | Kim | 128/206.17 |
| 2008/0302365 | A1 | 12/2008 | Cohen et al. | |
| 2009/0078261 | A1 | 3/2009 | Martin et al. | |
| 2009/0078265 | A1 | 3/2009 | Gebrewold et al. | |
| 2009/0320849 | A1 | 12/2009 | Biedermann | |
| 2011/0247626 | A1 * | 10/2011 | Chuang | 128/206.19 |
| 2012/0017911 | A1 | 1/2012 | Choi et al. | |
| 2012/0167891 | A1 * | 7/2012 | Smaller | 128/206.19 |

FOREIGN PATENT DOCUMENTS

| | | |
|---|---|---|
| JP | 2002-00130580 | 5/2002 |
| KR | 20-0280765 | 7/2002 |
| KR | 2010-0011691 | 1/2010 |
| WO | WO 2007/024865 A1 | 3/2007 |
| WO | WO 2008/051726 A1 | 5/2008 |

* cited by examiner

RESPIRATOR HAVING FOAM SHAPING LAYER WITH RECESSED REGIONS SURROUNDING AIR PASSAGEWAYS

The present invention pertains to a filtering face-piece respirator that has a foamed shaping layer that has a series of openings located in it, which openings are surrounded by regions recessed within the shaping layer.

BACKGROUND

Respirators are commonly worn over the breathing passages of a person for at least one of two common purposes: (1) to prevent impurities or contaminants from entering the wearer's breathing track; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or clean room.

Some respirators are categorized as being "filtering face-pieces" because the mask body itself functions as the filtering mechanism. Unlike respirators that use rubber or elastomeric mask bodies in conjunction with attachable filter cartridges or filter liners (see, e.g., U.S. Pat. No. RE39,493 to Yuschak et al. and U.S. Pat. No. 5,094,236 to Tayebi) or insert-molded filter elements (see, e.g., U.S. Pat. No. 4,790,306 to Braun), filtering face-piece respirators have the filter media extend over much of the whole mask body so that there is no need for installing or replacing a filter cartridge. As such, filtering face-piece respirators are relatively light in weight and easy to use.

Filtering face-piece respirators generally fall into one of two categories, namely, fold-flat respirators and shaped respirators. Fold-flat respirators are stored flat but include seams, pleats, and/or folds that allow the mask to be opened into a cup-shaped configuration for use. Examples of flat-fold filtering face-piece respirators are shown in U.S. Pat. Nos. 6,568,392 and 6,484,722 to Bostock et al. and U.S. Pat. No. 6,394,090 to Chen.

Shaped respirators, in contrast, are more-or-less permanently formed into a desired face-fitting configuration and generally retain that configuration during storage and use. Shaped filtering face-piece respirators regularly include a molded supporting shell structure, generally referred to as a "shaping layer", which is commonly made from thermally bonding fibers or an open-work plastic mesh. The shaping layer is primarily designed to provide support for a filtration layer. Relative to the filtration layer, the shaping layer may reside on an inner portion of the mask (adjacent to the face of the wearer), or it may reside on an outer portion of the mask, or on both inner and outer portions. Examples of patents that disclose shaping layers for supporting filtration layers include U.S. Pat. No. 4,536,440 to Berg, U.S. Pat. No. 4,807,619 to Dyrud et al., and U.S. Pat. No. 4,850,347 to Skov.

In constructing a mask body for a shaped respirator, the filtration layer is typically juxtaposed against the shaping layer, and the assembled layers are subjected to a molding operation by placing the assembled layers between heated male and female mold parts (see, for example, U.S. Pat. No. 4,536,440 to Berg) or by passing the layers in superimposed relation through a heating stage and thereafter cold molding the superimposed layers into the face mask shape (see U.S. Pat. No. 5,307,796 to Kronzer et al. and U.S. Pat. No. 4,850,347 to Skov).

In known shaped filtering face-piece respirators, the filtration layer—whether assembled into the mask body by either of the above-noted techniques—generally assumes the curved configuration of the molded shaping layer when being joined thereto. Once a harness is secured to the mask body, the product typically is ready for use. Sometimes an elastomeric face seal is also joined to the mask body at its perimeter to improve fit and wearer comfort. The a face seal extends radially inward to contact the wearer's face when the respirator is being donned. Documents that describe elastomeric face seal use include U.S. Pat. No. 6,568,392 to Bostock et al., U.S. Pat. No. 5,617,849 to Springett et al., and U.S. Pat. No. 4,600,002 to Maryyanek et al., and in Canadian Patent 1,296,487 to Yard. Additionally, nose foams and nose clips have been attached to the mask body to improve fit in the nose region where there is an extreme change in facial contour—see, for example, U.S. Patent Application Publications 2007/0068529A1 to Kalatoor et al. and 2008/0023006A1 to Kalatoor; International Publications WO2007/024865A1 Xue et al. and WO2008/051726A1 to Gebrewold et al., and U.S. Pat. Nos. 5,558,089 and Des. 412,573 to Castiglione. Once the respirator has met the end of its service life, the product is discarded since the filtering layer is not replaceable in a filtering face-piece respirator.

SUMMARY OF THE INVENTION

The present invention provides a molded filtering face-piece respirator that comprises a harness and a mask body. The mask body includes a filtering structure and a cup-shaped shaping layer where the latter comprises a closed cell foam layer that has a plurality of air permeable openings located therein. The closed cell foam layer also has recessed regions surrounding the plurality of openings.

Despite the open nature of the foam shaping layer in the present invention, the use of a closed cell foam shaping layer, which has recessed regions surrounding air passageways, can provide structural integrity or stiffness sufficient to prevent the mask body from collapsing during respirator use. The recessed regions and the areas located between such regions provide a beam like affect that increases the structural integrity of the mask body. The recessed regions each further act like individual plenums that allow for the rapid distribution of fluid between the filtering structure and the shaping layer to lower pressure drop across the mask body during respirator use. The lower pressure drop and improved airflow distribution may make the inventive respirator more comfortable to wear. The closed cell foam shaping layer also can provide a sufficient degree of pliability at the mask body perimeter, which enables the mask body to fit comfortably and snugly on a wearer's face without attachment or use of an elastomeric face seal, nose foam, or nose clip.

GLOSSARY

The terms set forth below will have the meanings as defined:

"apex region" means the area surrounding the highest point on the mask body when it is resting on a flat surface with the mask perimeter in contact with the surface;

"comprises (or comprising)" means its definition as is standard in patent terminology, being an open-ended term that is generally synonymous with "includes", "having", or "containing". Although "comprises", "includes", "having", and "containing" and variations thereof are commonly-used, open-ended terms, this invention also may be suitably described using narrower terms such as "consists essentially of", which is semi open-ended term in that it excludes only those things or elements that would have a deleterious effect on the performance of the inventive respirator in serving its intended function;

"clean air" means a volume of atmospheric ambient air that has been filtered to remove contaminants;

"coextensively" means extending parallel to and covering at least 80% of the surface area of another object;

"contaminants" means particles (including dusts, mists, and fumes) and/or other substances that generally may not be considered to be particles (e.g., organic vapors, et cetera) but which may be suspended in air, including air in an exhale flow stream;

"cover web" means a nonwoven fibrous layer that is not primarily designed for filtering contaminants;

"exterior gas space" means the ambient atmospheric gas space into which exhaled gas enters after passing through and beyond the mask body and/or exhalation valve;

"filtering face-piece" means that the mask body itself is designed to filter air that passes through it; there are no separately identifiable filter cartridges, filter liners, or insert-molded filter elements attached to or molded into the mask body to achieve this purpose;

"filter" or "filtration layer" means one or more layers of air-permeable material, which layer(s) is adapted for the primary purpose of removing contaminants (such as particles) from an air stream that passes through it;

"filtering structure" means a construction that is designed primarily for filtering air;

"harness" means a structure or combination of parts that assists in supporting the mask body on a wearer's face;

"integral" means that the parts in question were made at the same time as a single part and not as two separate parts subsequently joined together;

"interior gas space" means the space between a mask body and a person's face;

"mask body" means an air-permeable structure that is designed to fit over the nose and mouth of a person and that helps define an interior gas space separated from an exterior gas space;

"mid region" means an area between an apex region and the mask body perimeter;

"nose clip" means a mechanical device (other than a nose foam), which device is adapted for use on a mask body to improve the seal at least around a wearer's nose;

"nose foam" means a porous material that is adapted for placement on the interior of a mask body to improve fit and/or wearer comfort over the nose when the respirator is worn;

"nonwoven" means a structure or portion of a structure in which the fibers are held together by a means other than weaving;

"parallel" means being generally equidistant;

"perimeter" means the outer edge of the mask body, which outer edge would be disposed generally proximate to a wearer's face when the respirator is being donned by a person;

"polymeric" and "plastic" each mean a material that mainly includes one or more polymers and may contain other ingredients as well;

"plurality" means two or more;

"recessed region" means a portion of the shaping layer that is significantly recessed from the outer surface of the shaping layer;

"respirator" means an air filtration device that is worn by a person on the face over the nose and mouth to provide clean air for the wearer to breathe;

"shaping layer" means a layer that has sufficient structural integrity to retain its desired shape (and the shape of other layers that are supported by it) under normal handling;

"valley" or "rib" means a portion of the shaping layer that is located between two recessed regions; and "web" means a structure that is significantly larger in two dimensions than in a third and that is air permeable.

DETAILED DESCRIPTION OF PREFERRED EMBODIMENTS

In practicing the present invention, a filtering face-piece respirator is provided which includes a closed-cell foam shaping layer. The shaping layer makes contact with the person's face at the mask body perimeter when the respirator is being worn. The shaping layer, which has a plurality of sufficiently-sized air permeable openings, typically occupying at least 10% of the shaping layer surface area, allows air to easily pass into the mask body interior gas space after being filtered to enable the respirator to be comfortably worn by a person. The shaping layer also has a series of recessed regions and valleys or ribs that increase the stiffness of the mask body and that further allow for the rapid distribution of the inhaled air within the interior gas space.

During respirator use, the wearer's lungs provide the energy needed to drive ambient air through the mask body from the exterior gas space to the interior gas space. When the pressure drop is low, less energy is needed to filter the ambient air. When a respirator is being worn for a prolonged time period, a lower pressure drop can be very beneficial to the wearer in that less work or energy is needed to breathe clean air. Pressure drop, particularly when coupled with particle penetration in the form of a quality factor ($Q_F$) measurement, is an established measure of respirator performance—see, for example, U.S. Pat. No. 6,923,182 to Angadjivand et al. The ability of the invention to provide a sturdy filtering face-piece respirator that exhibits good fit and performance, while using an air-impermeable closed cell foam material as a shaping layer, may be particularly beneficial to respirator users and manufacturers.

Figure 1:
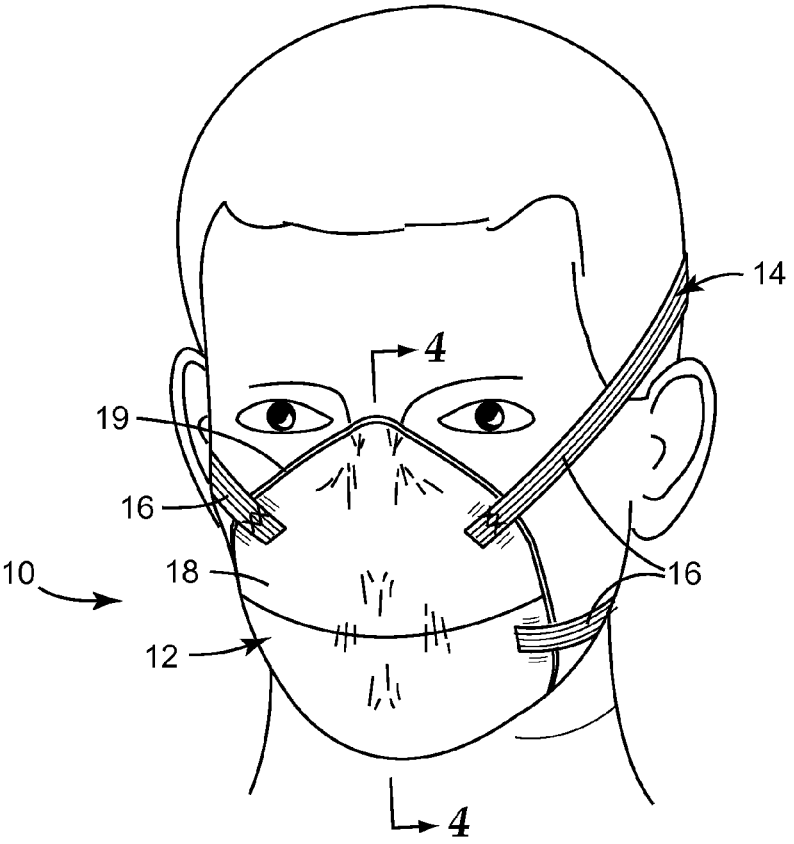
FIG. 1 is a perspective view of a filtering face piece respirator 10 in accordance with the present invention.

FIG. 1 shows a filtering face-piece respirator 10 that includes a mask body 12 and a harness 14. The harness 14 may comprise one or more straps 16 that may be made from an elastic material. The harness straps may be secured to the mask body by a variety of means including adhesive means, bonding means, or mechanical means (see, for example, U.S. Pat. No. 6,729,332 to Castiglione). The harness could, for example, be ultrasonically welded to the mask body or be stapled to the mask body. The mask body 12 comprises a filtering structure 18 and a shaping layer. The filtering structure 18 is located on the exterior of the shaping layer and can be seen from the front. The filtering structure 18 may be joined to the shaping layer along the mask body perimeter 19.

Figure 2:
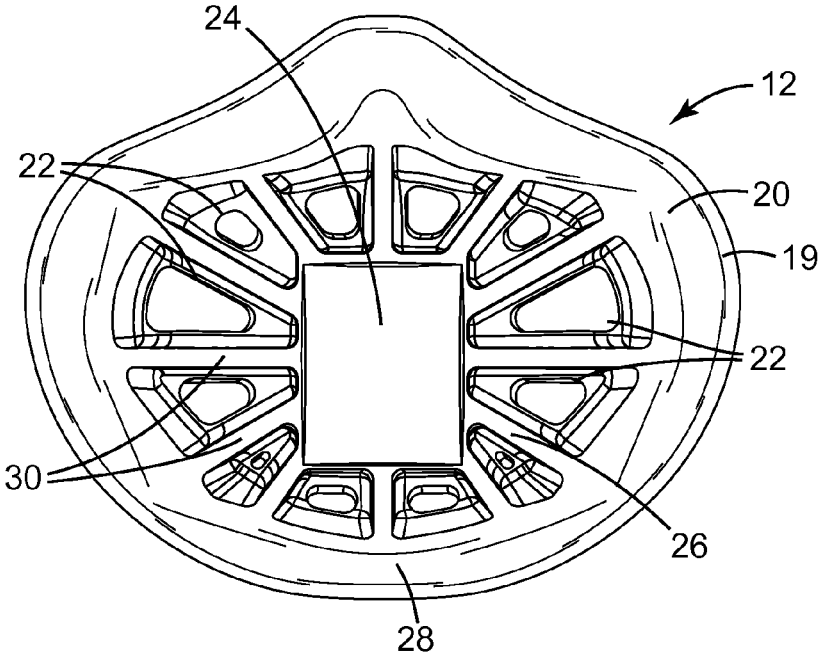
FIG. 2 is a rear view of the mask body 12 shown in FIG. 1.

FIG. 2 shows a rear view of the mask body 12, in particular the inner shaping layer 20 that comprises a closed-cell foam material. The shaping layer 20 makes contact with the wearer's face at the mask body perimeter 19 when the respirator is being worn. The shaping layer 20 includes a plurality of openings 22 that generally are sized to provide the shaping layer with an Equivalent Breathing Opening (EBO) of about 10 to 50 square centimeters ($cm^2$), more commonly 12 to 30 $cm^2$. The openings collectively occupy at least 5%, typically at least 8%, more typically about 12 to 40% of the total surface area of the shaping layer. The openings 22 may be located in the apex region 24 of the mask body as well as in its mid-region 26. The openings 22 may further extend down into the perimeter region 28 of the mask body. The mid region typically occupies about 300 to 500 square millimeters ($mm^2$) The openings 22 are separated from each other by ribs 30 that appear as valleys between the recessed regions 31 when the mask body 12 is viewed from the rear as shown in FIG. 2. The ribs 30 are generally about 2 to 15 mm wide, more typically about 3 to 7 mm wide. The openings 22 may take on a variety of shapes, including circular, oval, elliptical, rhomboid, square, rectangular, triangular, diamond, etc. The openings also are surrounded by a recessed region 31. The recessed regions 31 collectively occupy about 10 to 70% of the total surface area of the shaping layer 20, more typically about 12 to 40% of the total surface area of the shaping layer 20, including the openings that the recessed regions surround. Each recessed region individually typically occupies about 3 to 25 square centimeters ($cm^2$), more typically 5 to 20 $cm^2$ in surface area inclusive of the opening located therein. The area of the shaping layer is measured to include the sidewall of the recessed area. The recessed regions are recessed from the filtering structure or outer surface of the shaping layer at 3 millimeters to 1 centimeter, more typically about 4 to 7 mm. The recessed regions 31 also may come in a variety of configurations such as circular, elliptical, triangular, trapezoidal, rectangular, and those cited above with respect to the opening shape. Ribs 30 generally extend radially outward from the mask apex between the recessed regions.

When an exhalation valve is placed on the filtering face-piece respirator, it may be secured to the mask body at the apex region 24. Alternatively, a frame may be molded into the apex region 24 of the mask body to accommodate the exhalation valve—see U.S. Patent Application Publication No. 2009/0078264A1 to Martin et al. Thus, when an exhalation valve is desired, the openings that are provided in the shaping layer for accommodating fluid flow through the filtering structure would be generally absent from the portion of the apex region that accommodates the exhalation valve—that is, where the frame is located.

Figure 3:
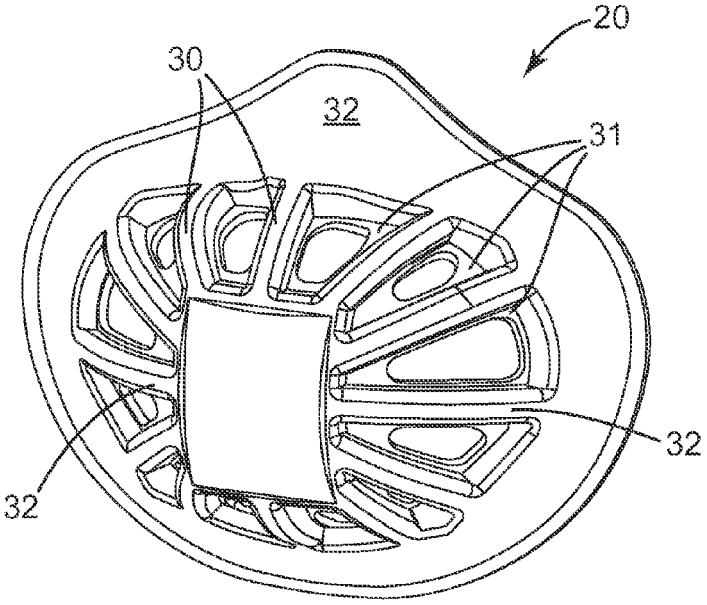
FIG. 3. is a perspective view of the shaping layer 20 in accordance with the present invention.

FIG. 3 shows the front side of the mask body 12 and each of the recessed regions 31 which have ribs 30 located between the recessed regions 31. The ribs make contact with material in a filtering structure that is disposed thereover when the respirator is assembled. The recessed regions 31 are recessed radially inward form the exterior surface 32 of the shaping layer 20. The filtering structure 18 (FIGS. 1 and 4) thus does not make contact, or substantial contact, with the outer surface 32 of the shaping layer 20 in the recessed region 31.

Figure 4:
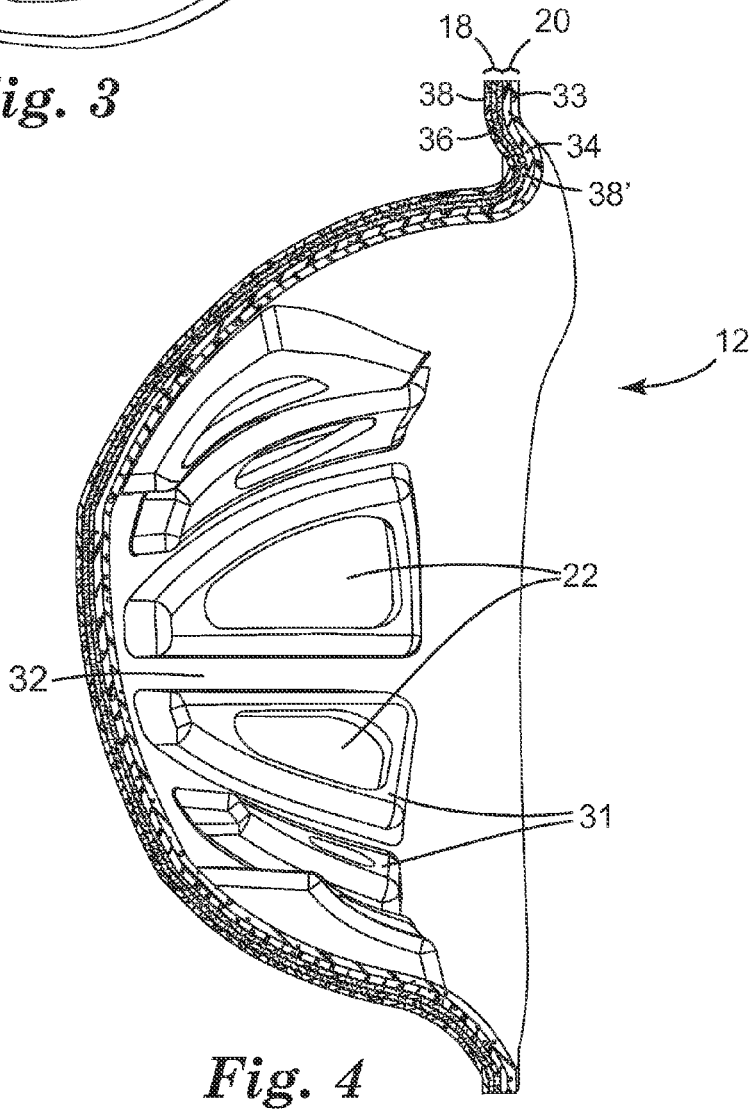
FIG. 4 is a cross-sectional view of the mask body 12 taken along lines 4-4 of FIG. 1.

FIG. 4 shows that the shaping layer 20 may comprise a plurality of layers. The first inner compliant layer 33 may be made from a closed-cell foam material that exhibits a lower density than the outer structural foam layer 34. The inner compliant layer may exhibit an apparent density of about 0.02 to 0.1 $g/cm^3$. The compressive strength of the inner layer 33 may be from about 0.25 to 1 KiloPascals (KPa), more typically about 0.3 to 0.5 KPa. The second outer foam layer 34 may exhibit an apparent density of about 0.05 to 0.5 $g/cm^3$ and a compressive strength of about 0.25 to 3 KPa, more commonly about 1 to 2.5 KPa. Being less dense, the inner layer 33 tends to be more conformable or compliant to facial features to provide a snug and comfortable fit. As an alternative to an inner foam layer, a nonwoven web may be used to provide a compliant face contacting layer for the shaping layer. To serve as an adequate face-contacting layer, the fibrous inner layer should be able to be bonded to the second outer layer and should have soft feeling and may provide a sweat absorbing property giving extra comfort. Examples of fibrous inner layers may include carded web or spunbond web or fabric of polyethyleneterephthalate or polypropylene or polyamide or rayon. The layers may be joined together by various techniques, including chemical and physical bonding. The filtering structure 18 too may include one or more layers of nonwoven fibrous material, such as a filtration layer 36 and an inner and outer cover webs 38, 38' on the outside of or upstream to the foam shaping layer 20. The cover web(s) 30, 38' may be provided to protect the filtration layer 38 and to preclude fibers in the filtration layer 36 from coming loose from the mask body 12. Although two cover webs 38, 38' are shown, the filtering structure may be fashioned to have only an outer cover web 38 or no cover web at all. During respirator use, air passes sequentially through layers 38, 36, 38' and the openings 22 in shaping layer 20 before entering the mask interior. The recessed regions 31 each act as plenums that assist in rapidly distributing the filtered air into the mask body interior gas space. The air that is present within the interior gas space of the mask body 12 may then be inhaled by the wearer. When a wearer exhales, the air passes in the opposite direction, sequentially through layers 20, 38', 36, and 38. Alternatively, an exhalation valve (not shown) may be provided on the mask body 12 to allow exhaled air to be rapidly purged from the interior gas space to enter the exterior gas space without passing through filtering structure 18. Typically, the cover web(s) 38, 38' is made from a selection of nonwoven materials that provide a low pressure drop while adding little weight to the final product. The construction of various filter layers and cover web(s) that may be used in conjunction with the filtering structure are described below in more detail. The filtering face-piece respirator of the present invention may exhibit a pressure drop less than 120 Pa, more preferably less than 100 Pa, and still more preferably less than 90 Pa. The Quality Factor, $Q_F$, may be greater than 0.5, greater than 0.6, and even greater than 0.8. The mask body 12, which includes the filtering structure 18 and the shaping layer 20 (FIG. 3), may exhibit a stiffness of at least 4 Newtons (N), at least about 6 N, and even at least 8 N. Stiffness may be determined according to the Mask Stiffness Test set forth below.

The mask body that is used in connection with the present invention may have a curved hemispherical shape as shown in FIG. 1 (see also U.S. Pat. No. 4,807,619 to Dyrud et al.) or it may take on a variety of different shapes and configurations—see, for example, U.S. Pat. No. 4,827,924 to Japuntich. As indicated above, the shaping layer may include one or more layers of foam having different densities. The foam layers also may be made from different polymeric materials. The inner layer—that is, the layer closer to the face—may be made from, for example, low density polyethylene, polyvinylchloride, polyurethane, or natural or synthetic rubber. The outer layer may comprise one or more of the following polymers: polypropylene, ethyl vinyl acetate, polyamide, or polyester. The plural layer shaping layer may be made from nonwovens or fabric, for example polyethyleneterephthalate or polyamide or polypropylene or rayon. Although a filtering structure has been illustrated with multiple layers that include a filtration layer and a cover web, the filtering structure may simply comprise a combination of filtration layers or a combination of filter layer(s) and cover web(s). For example, a pre-filter may be disposed upstream to a more refined and selective downstream filtration layer. Additionally, sorptive materials such as activated carbon may be disposed between the fibers and/or various layers that comprise the filtering structure, although such sorptive materials may be absent from the nose region so as to not compromise the desired snug fit. Further, separate particulate filtration layers may be used in conjunction with sorptive layers to provide filtration for both particulates and vapors. The filtering structure may include one or more stiffening layers that assist in providing a cup-shaped configuration during use. The filtering structure also could have one or more horizontal and/or vertical lines of demarcation, such as a weld or bond line, that contribute to its structural integrity.

The filtering structure that is used in a mask body of the invention can be of a particle capture or gas and vapor type filter. The filtering structure also may be a barrier layer that prevents the transfer of liquid from one side of the filter layer to another to prevent, for instance, liquid aerosols or liquid splashes (e.g. blood) from penetrating the filter layer. Multiple layers of similar or dissimilar filter media may be used to construct the filtering structure of the invention as the application requires. Filters that may be beneficially employed in a layered mask body of the invention are generally low in pressure drop (for example, less than about 200 to 300 Pascals at a face velocity of 13.8 centimeters per second) to minimize the breathing work of the mask wearer. Filtration layers additionally are flexible and have sufficient shear strength so that they generally retain their structure under the expected use conditions. Examples of particle capture filters include one or more webs of fine inorganic fibers (such as fiberglass) or polymeric synthetic fibers. Synthetic fiber webs may include electret-charged polymeric microfibers that are produced from processes such as meltblowing. Polyolefin microfibers formed from polypropylene that has been electrically charged provide particular utility for particulate capture applications.

The filtration layer is typically chosen to achieve a desired filtering effect. The filtration layer generally will remove a high percentage of particles and/or or other contaminants from the gaseous stream that passes through it. For fibrous filter layers, the fibers selected depend upon the kind of substance to be filtered and, typically, are chosen so that they do not become bonded together during the manufacturing operation. As indicated, the filtration layer may come in a variety of shapes and forms and typically has a thickness of about 0.2 millimeters (mm) to 1 centimeter (cm), more typically about 0.3 mm to 0.5 cm, and it could be a generally planar web or it could be corrugated to provide an expanded surface area—see, for example, U.S. Pat. Nos. 5,804,295 and 5,656,368 to Braun et al. The filtration layer also may include multiple filtration layers joined together by an adhesive or any other means. Essentially any suitable material that is known (or later developed) for forming a filtering layer may be used as the filtering material. Webs of melt-blown fibers, such as those taught in Wente, Van A., *Superfine Thermoplastic Fibers,* 48 Indus. Engn. Chem., 1342 et seq. (1956), especially when in a persistent electrically charged (electret) form are especially useful (see, for example, U.S. Pat. No. 4,215,682 to Kubik et al.). These melt-blown fibers may be microfibers that have an effective fiber diameter less than about 20 micrometers (μm) (referred to as BMF for "blown microfiber"), typically about 1 to 12 μm. Effective fiber diameter may be determined according to Davies, C. N., *The Separation Of Airborne Dust Particles*, Institution Of Mechanical Engineers, London, Proceedings 1B, 1952. Particularly preferred are BMF webs that contain fibers formed from polypropylene, poly(4-methyl-1-pentene), and combinations thereof. Meltblown webs may be made using the apparatus and die described in U.S. Pat. No. 7,690,902 to Erickson et al. Electrically charged fibrillated-film fibers as taught in van Turnhout, U.S. Pat. No. Re. 31,285, also may be suitable, as well as rosin-wool fibrous webs and webs of glass fibers or solution-blown, or electrostatically sprayed fibers, especially in microfiber form. Nanofiber webs also may be used as a filtering layer—see U.S. Pat. No. 7,691,168 to Fox et al. Electric charge can be imparted to the fibers by contacting the fibers with water as disclosed in U.S. Pat. No. 6,824,718 to Eitzman et al., U.S. Pat. No. 6,783,574 to Angadjivand et al., U.S. Pat. No. 6,743,464 to Insley et al., U.S. Pat. Nos. 6,454,986 and 6,406,657 to Eitzman et al., and U.S. Pat. Nos. 6,375,886 and 5,496,507 to Angadjivand et al. Electric charge also may be imparted to the fibers by corona charging as disclosed in U.S. Pat. No. 4,588,537 to Klasse et al. or by tribocharging as disclosed in U.S. Pat. No. 4,798,850 to Brown. Also, additives can be included in the fibers to enhance the filtration performance of webs produced through the hydro-charging process (see U.S. Pat. No. 5,908,598 to Rousseau et al.). Fluorine atoms, in particular, can be disposed at the surface of the fibers in the filter layer to improve filtration performance in an oily mist environment—see U.S. Pat. Nos. 6,398,847 B1, 6,397,458 B1, and 6,409,806 B1 to Jones et al.; U.S. Pat. No. 7,244,292 to Kirk et al.; U.S. Pat. No. 7,244,291 to Spartz et al.; and U.S. Pat. No. 7,765,698 to Sebastian et al. Typical basis weights for electret BMF filtration layers are about 10 to 100 grams per square meter ($g/m^2$). When electrically charged and optionally fluorinated as mentioned above, the basis weight may be about 20 to 40 $g/m^2$ and about 10 to 30 $g/m^2$, respectively.

The cover web can be used to entrap loose fibers in the mask body and for aesthetic reasons. The cover web typically does not provide any substantial filtering benefits to the filtering structure, although it can act as a pre-filter when disposed on the exterior of (or upstream to) the filtration layer. The cover web preferably has a comparatively low basis weight and is formed from comparatively fine fibers. More particularly, the cover web may be fashioned to have a basis weight of about 5 to 50 $g/m^2$ (typically 10 to 30 $g/m^2$), and the fibers may be less than 3.5 denier (typically less than 2 denier, and more typically less than 1 denier but greater than 0.1 denier). Fibers used in the cover web often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Suitable materials for the cover web may be blown microfiber (BMF) materials, particularly polyolefin BMF materials, for example polypropylene BMF materials (including polypropylene blends and also blends of polypropylene and polyethylene). A suitable process for producing BMF materials for a cover web is described in U.S. Pat. No. 4,013,816 to Sabee et al. The web may be formed by collecting the fibers on a smooth surface, typically a smooth-surfaced drum or a rotating collector—see U.S. Pat. No. 6,492,286 to Berrigan et al. Spun-bond fibers also may be used.

A typical cover web may be made from polypropylene or a polypropylene/polyolefin blend that contains 50 weight percent or more polypropylene. These materials have been found to offer high degrees of softness and comfort to the wearer and also, when the filter material is a polypropylene BMF material, to remain secured to the filter material without requiring an adhesive between the layers. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. One example of a fiber for the cover web is a polypropylene BMF made from the polypropylene resin "Escorene 3505G" from Exxon Corporation, providing a basis weight of about 25 g/m$^2$ and having a fiber denier in the range 0.2 to 3.1 (with an average, measured over 100 fibers of about 0.8). Another suitable fiber is a polypropylene/polyethylene BMF (produced from a mixture comprising 85 percent of the resin "Escorene 3505G" and 15 percent of the ethylene/alpha-olefin copolymer "Exact 4023" also from Exxon Corporation) providing a basis weight of about 25 g/m$^2$ and having an average fiber denier of about 0.8. Suitable spunbond materials are available, under the trade designations "Corosoft Plus 20", "Corosoft Classic 20" and "Corovin PP-S-14", from Corovin GmbH of Peine, Germany, and a carded polypropylene/viscose material available, under the trade designation "370/15", from J. W. Suominen OY of Nakila, Finland.

Cover webs that are used in the invention generally have very few fibers protruding from the web surface after processing and therefore have a smooth outer surface. Examples of cover webs that may be used in the present invention are disclosed, for example, in U.S. Pat. No. 6,041,782 to Angadjivand, U.S. Pat. No. 6,123,077 to Bostock et al., and WO 96/28216A to Bostock et al.

The strap(s) that are used in the harness may be made from a variety of materials, such as thermoset rubbers, thermoplastic elastomers, braided or knitted yarn/rubber combinations, inelastic braided components, and the like. The strap(s) may be made from an elastic material such as an elastic braided material. The strap preferably can be expanded to greater than twice its total length and be returned to its relaxed state. The strap also could possibly be increased to three or four times its relaxed state length and can be returned to its original condition without any damage thereto when the tensile forces are removed. The elastic limit thus is generally not less than two, three, or four times the length of the strap when in its relaxed state. Typically, the strap(s) are about 20 to 30 cm long, 3 to 10 mm wide, and about 0.9 to 1.5 mm thick. The strap(s) may extend from the first side to the second side as a continuous strap or the strap may have a plurality of parts, which can be joined together by further fasteners or buckles. For example, the strap may have first and second parts that are joined together by a fastener that can be quickly uncoupled by the wearer when removing the mask body from the face. An example of a strap that may be used in connection with the present invention is shown in U.S. Pat. No. 6,332,465 to Xue et al. Examples of a fastening or clasping mechanism that may be used to joint one or more parts of the strap together is shown, for example, in the following U.S. Pat. No. 6,062,221 to Brostrom et al., U.S. Pat. No. 5,237,986 to Seppala, and EP1,495,785A1 to Chien and in U.S. Patent Publication 2009/0193628A1 to Gebrewold et al. and International Publication WO2009/038956A2 to Stepan et al.

As indicated, an exhalation valve may be attached to the mask body to facilitate purging exhaled air from the interior gas space. The use of an exhalation valve may improve wearer comfort by rapidly removing the warm moist exhaled air from the mask interior. See, for example, U.S. Pat. Nos. 7,188,622, 7,028,689, and 7,013,895 to Martin et al.; U.S. Pat. Nos. 7,493,900, 7,428,903, 7,311,104, 7,117,868, 6,854,463, 6,843,248, and 5,325,892 to Japuntich et al.; U.S. Pat. Nos. 7,849,856 and 6,883,518 to Mittelstadt et al.; and U.S. Pat. No. RE 37,974 to Bowers. Essentially any exhalation valve that provides a suitable pressure drop and that can be properly secured to the mask body may be used in connection with the present invention to rapidly deliver exhaled air from the interior gas space to the exterior gas space.

EXAMPLES

Test Methods

The following test methods were used to evaluate filter webs, molded foam elements, and finished masks:

Particulate Penetration and Pressure Drop

Particle penetration and pressure drop measurements for both filter webs and finished masks were determined using an AFT Tester, Model 8130, from TSI Incorporated; St. Paul, Minn. A Sodium Chloride (NaCl) challenge, delivered at a concentration of 20 milligrams per cubic meter (mg/m$^3$) and face velocity of 13.8 centimeters per second (cm/sec) was used as the test aerosol. During a test, the concentration of the aerosol on the downstream side of the filter web or mask was determined and compared to the challenge concentration. The percent penetration of a test subject is given as a percentage of the downstream concentration of sodium chloride divided by the upstream concentration of the challenge and is reported as percent penetration. In addition to filter efficiency the pressure drop across the test subject was recorded and reported in pascals (Pa).

Mask Stiffness

Stiffness of a mask was measured using a King Stiffness Tester; model SASD-672, available from J.A. King & Co., 2620 High Point Road, Greensboro, N.C. Stiffness was determined as the force required to push a 2.54 cm-diameter, fiat-faced probe into the apex of the face mask. To conduct the test the probe was positioned over the apex of the mask, which rested on the fixture platform. The probe was then extended towards the mask at a cross head speed of 32 mm/sec so that the mask was compressed 21 millimeters. At the end of the full extension of the probe, the force required to compress the mask was recorded in Newtons (N).

Apparent Foam Density

Apparent density of the foam material was determined by ASTM D3575-08, Suffix W, Method A. Values of apparent density are reported as grams per cubic centimeter (g/cm$^3$).

Compressive Strength

Compressive strength of foam was determined by ASTM D3575-08, Suffix D. Values for compressive strength are reported as kilopascals (kPa).

Equivalent Breathing Opening

The Equivalent Breathing Opening (EBO) of a mask was determined by first finding the hydraulic radius $R_h$ of a representative breathing opening through the foam layer of the mask. Hydraulic radius of an opening was calculated by dividing the area of the opening by the opening perimeter length. Area and perimeter of representative openings were determined using an optical comparator (DZ2, High Magnification Zoom Microscope, Union Optical Co., LTD, and Image-Pro® Plus, Media Cybernetics, Inc.). If more than one breathing opening configuration was used in a mask, then the hydraulic radius of each representative opening is determined $R(n)_h$, where n represents a particular opening size. The EBO is then calculated as follows:

$$EBO \equiv 4\pi \sum_{n=1}^{N} a_n (R_n)_h^2$$

Where:

$a_n$ is the number of representative openings of a particular size n $R(n)_h$ is the hydraulic radius of representative opening n For a mask that has n openings all of the same hydraulic radius, the EBO would be calculated as:

$$EBO = 4\pi R_h^2$$

The value of the hydraulic radius is given in centimeters (cm) and the calculated value of EBO as square centimeters ($cm^2$).

Example 1

A cup-shaped mask of the invention was prepared from two basic elements, a structural foam shaping layer and a filtering preform. The structural foam shaping layer was prepared by first laminating two layers of material: an inner compliant layer and an outer structural layer. The material used for the outer structural layer was closed cell polypropylene foam, EPILON® Q1001.1 W, supplied by Yongbo Chemical, Daejeon-Si, Korea. Apparent density and compressive strength of the outer structural layer was 0.1013 g/$cm^3$ and 1.14 kPa, respectively. The inner compliant layer material was closed cell polyethylene foam, EPILON® R3003 W, also available from Yongbo Chemical, Daejeon-Si, Korea. Apparent density and compressive strength of the foam was 0.0322 g/$cm^3$ and 0.32 kPa respectively. Lamination of the layers was accomplished through a flame lamination process.

Flame lamination involved exposing a face of the outer structural foam layer to a controlled flame in a continuous roll lamination process where the surface of the foam was heated to approximately 200° c. The compliant foam layer, drawn from a roll on the laminator, was then brought into direct contact with the heated foam surface under controlled line tension. The layers were then passed over a 20 cm diameter rolling mandrel with an approach angle of 45 degrees. Cooling of the heated foam, under the compression resulting from the line tension and contact with the rolling mandrel, caused the layers to cohesively bond at their interface. The laminator line tension and speed were 3 Newtons per centimeter (of line width) and 15.1 meters per minute, respectively. The laminated structure was then perforated with a pattern of breathing openings that were cut through the laminate using a rule die.

There were twelve triangular and trapezoidal openings that were generally equally spaced and were surrounded by the recessed regions that exhibited triangular and trapezoidal patterns as shown in FIG. 2. The shaped openings had side lengths that ranged from 8 mm to 35 mm. Twelve openings were created over an area that generally constituted the mid-region of the mask body. The mid-region of the shaping layer, over which the hole pattern was cut, had a large perimeter of about 92 mm and a small perimeter of about 28 mm and occupied an area of about 423 $mm^2$. The shaping layer, in proximity of what would result as nose bridge of the mask, was left uncut. The die cut foam laminate sheet was then formed into the structural cup-shaped configuration of the mask shown in FIGS. 1-4 through a molding step. The recessed regions Molding of the cut laminate was done by pressing the laminated layers between mating female and male mold halves. The generally hemispherical mask-shaped female mold had a depth of about 55 mm and a volume of 310 $cm^3$, the male part of the mold mirrored the female half of the mold. In the molding step, the male and female halves of the mold were heated to approximately 105° C. The laminated sheet was then placed between the mold halves such that the nosepiece of the mask was properly orientated, and the mold closed to a gap of 2.5 mm. A dwell time of approximately 10 to 15 seconds was held prior to opening the mold and removing the structural cup. After the molding step, the openings in the mask were generally uniform in size and determined to have an $R_h$ of 1.4~4.62 mm. The shaping layer was had an EBO of about 15.9 $cm^2$. The openings occupied 10% of the total surface area of the shaping layer. The openings were located in mid-region of the mask body as shown in FIG. 2. The openings were separated from each other by ribs that appeared as valleys between the recessed regions when the mask body was viewed from the rear. The ribs were about 4 mm wide. The openings were surrounded by a recessed region that exhibited 5 mm in depth from the outer surface of the shaping layer. The recessed regions collectively occupied about 14% of the total surface area of the shaping layer. Each recessed region individually occupied about 6.4 to 14.1 $cm^2$ in surface area inclusive of the opening located therein.

The filtering element of the mask was constructed as a preform, which was attached to the cup-shaped shaping layer. The preform was made by layering filter and protective cover webs together and ultrasonically welding a forming edge through the layers. To construct the preform, 198 cm×202 cm sheets of material were layered in the sequence of: cover-web/filter-web/filter-web/cover-web. A parabolic curve was then welded through the layers, the resultant shape mimicking the arcuate profile of the structural foam cup. The cover web used in the preform was 30 grams per square meter (gsm), polypropylene spun bond, LIVESEN® 30 SS, available from Toray Advanced Material Korea Inc., Seoul, Korea. The filter web used was a 110 grams/square meter (gsm), blown micro fiber web, having effective fiber diameter (EFD) of 9 microns (μm), as calculated according to the method set forth in Davis, C. N., *The Separation Of Airborne Dust Particles*, Institution Of Mechanical Engineers, London, Proceedings 1B, 1952. The microfiber web had a thickness of 1.7 millimeters (mm) when subjected to a compressive load of 13.8 pascal (Pa). The microfiber web was made from polypropylene (Fina 3857, from Fina Oil and Chemical Co., Houston, Tex.) using the method generally taught in Wente, Van A, Superfine Thermoplastic Fibers, 48 Indus. Engn. Chern., 1342 et seq. (1956). A persistent electrostatic charge (electret) was induced in the microfiber web by the method generally described in U.S. Pat. No. 6,119,691. The resulting web had a 3.2% penetration and a pressure drop of 73.5 Pa, giving a quality factor $Q_F$ of 0.46. To form the mask of the example, the preform which is a lamination of cover web and filter media was unfolded and placed over the shaping layer, with the filter media towards the cup. The assembly was then edge sealed, around the mask base, using ultrasonic welding to fuse the preform to the shaping layer at its outer rim and to trim off excess material.

The mask was evaluated for crush resistance (stiffness), particle penetration, and pressure drop. Test results are given in Table 1, which also includes the EBO value.

Example 2

Example 2 was produced according to Example 1 with the exception that in the resulting openings were circle-shaped holes having a diameter of 5 mm. These holes were disposed in the recessed regions described above. There were approximately 80 holes in the twelve recessed regions. The openings in the mask body were generally uniform in size and were determined to have an $R_h$ range of 1.3 mm. The EBO of the shaping layer was about 15.7 $cm^2$. The openings occupied about 26% of the total surface area of the shaping layer.

Example 3

Example 3 was produced as was Example 1, with the exception that a thermal bonded nonwoven web was use as the compliant layer. The 200 gsm nonwoven web was prepared on a "Rando Webber" air-laying machine (available from Rando Machine Corporation, Macedon, N.Y.) using a blend of 4 denier (dpf) low melting fiber (LMF 4 DE', 51 mm, Huvis Corp., Seoul, Korea) and 6 denier polyester staple fiber (RSF 6 DE', 38 mm, Huvis Corp., Seoul, Korea). Composition of the blend was 70 weight percent 4 dpf fiber and 30 weight percent 6 dpf fibers. The loose web was thermal bonded by passing it through an over at oven at 120° C. for 30 seconds.

The mask was evaluated for crush resistance (stiffness), particle penetration, and pressure drop. Test results are given in Table 1, which also includes the EBO value.

Example 4

Example 4 was produced as was Example 3 with the exception that the breathing opening pattern of Example 2 was used.

The mask was evaluated for crush resistance (stiffness), particle penetration, and pressure drop. Test results are given in Table 1, which also includes the EBO value.

Comparative Example 1

Comparative Example 1 was prepared and tested in the manner as described in Example 1, using same filtration layer and a conventional nonwoven inner layer.

TABLE 1

| | EBO ($cm^2$) | Stiffness (N) | Pressure Drop (Pa) | Penetration (%) | $Q_F$ (1/mmH2O) |
|---|---|---|---|---|---|
| Example 1 | 15.9 | 4.6 | 82.4 | 0.075 | 0.86 |
| Example 2 | 15.7 | 4.1 | 83.4 | 0.083 | 0.83 |
| Example 3 | 15.9 | 6.1 | 114.7 | 0.155 | 0.55 |
| Example 4 | 15.7 | 8.4 | 105.9 | 0.043 | 0.72 |
| Comparative Example 1 | N.A. | 3.4 | 70.6 | 0.043 | 1.08 |

Although the Example masks generally exhibited a higher pressure drop than a comparative sample, they were found to be comfortable to wear and provided a good face fit. It was also observed that the shaping layer retained the overall mask form while the inner compliant layer conformed around the nose and chin area of the wearer to enhance fit. Breathing resistance through the mask was surprisingly low, even though sizable portion of the shaping layer was closed off by the foam.

What is claimed is:

1. A filtering face-piece respirator that comprises:
a harness; and
a mask body that comprises:
a filtering structure; and
a cup-shaped shaping layer that comprises a closed cell foam layer that has a plurality of air permeable openings located therein and a plurality of recessed regions formed in an outer surface of the cup-shaped shaping layer, wherein each air permeable opening of the plurality of air permeable openings comprises a first end at the outer surface of the cup-shaped shaping layer and a second end at an inner surface of the cup-shaped shaping layer, wherein the first end of each air permeable opening of the plurality of air permeable openings is surrounded by a recessed region of the plurality of recessed regions.

2. The filtering face-piece respirator of claim 1, wherein each recessed region is recessed from the filtering structure at 3 millimeters to 1 centimeter.

3. The filtering face-piece respirator of claim 2, wherein each recessed region is recessed from the filtering structure at 4 millimeters to 7 millimeters.

4. The filtering face-piece respirator of claim 3, wherein the mask body lacks a nose foam and an elastomeric face seal.

5. The filtering face-piece respirator of claim 2, wherein the plurality of recessed regions collectively occupy 10 to 70% of the total surface area of the outer surface of the shaping layer.

6. The filtering face-piece respirator of claim 5, wherein the air permeable openings provide the shaping layer with an Equivalent Breathing Opening of 10 to 50 $cm^2$.

7. The filtering face-piece respirator of claim 5, wherein the openings provide the shaping layer with an Equivalent Breathing Opening of 12 to 30 $cm^2$.

8. The filtering face-piece respirator of claim 2, wherein each recessed region occupies 3 to 25 square centimeters including the encompassed opening within each recessed region.

9. The filtering face-piece respirator of claim 2, wherein the ribs are two millimeters to one centimeter wide.

10. The filtering face-piece respirator of claim 1, wherein the air permeable openings occupy 10 to 30% of the total surface area of the outer surface of the shaping layer.

11. The filtering face-piece respirator of claim 1, wherein the filtering structure is joined to the shaping layer at least along the whole perimeter of the mask body.

12. The filtering face-piece respirator of claim 1, wherein the mask body has a stiffness of at least 2 Newtons.

13. The filtering face-piece respirator of claim 1, wherein the mask body has a stiffness of at least 2.5 Newtons.

14. The filtering face-piece respirator of claim 1, wherein the filtering structure is positioned over the mask body such that the shaping layer makes contact with the wearer's face at the mask body perimeter when the respirator is being worn.

15. The filtering face-piece respirator of claim 1, wherein the plurality of recessed regions occupies 12 to 40% of the total surface area of the outer surface of the shaping layer, including the openings that the recessed regions surround.

16. The filtering face-piece respirator of claim 15, wherein each recessed region is recessed 4 to 7 mm from the outer surface of the shaping layer.

17. The filtering face-piece respirator of claim 16, wherein the plurality of recessed regions is present in the mid-region of the shaping layer.

18. The filtering face-piece respirator of claim 17, wherein the recessed regions are triangular or rectangular in shape.

19. The filtering face-piece respirator of claim 1, wherein there is a rib between adjacent recessed regions.

20. A filtering face-piece respirator that comprises a harness and a mask body, wherein the mask body comprises:
a filtering structure; and
a cup-shaped shaping layer that comprises:
a closed cell foam layer that has a plurality of fluid permeable openings located therein, wherein each fluid permeable opening of the plurality of fluid permeable openings comprises a first end at an outer surface of the cup-shaped shaping layer and a second end at an inner surface of the cup-shaped shaping layer;

a plurality of recessed regions formed in the outer surface of the cup-shaped shaping layer, wherein the first end of each fluid permeable opening is surrounded by a recessed region of the plurality of recessed regions, and wherein each recessed region is recessed at least 3 mm; and ribs located between adjacent recessed regions;

wherein the filtering structure is in contact with the shaping layer, but such contact not occurring at the recessed regions, wherein the plurality of recessed regions collectively occupies 10 to 70% of the total surface area of the outer surface of the shaping layer, and wherein the cup-shaped shaping layer is present along the periphery of the mask body.

* * * * *